US006308790B1

(12) United States Patent
Mensa-Wilmot et al.

(10) Patent No.: US 6,308,790 B1
(45) Date of Patent: Oct. 30, 2001

(54) DRAG BITS WITH PREDICTABLE INCLINATION TENDENCIES AND BEHAVIOR

(75) Inventors: Graham Mensa-Wilmot, Houston; John H. Simmons, Missouri City, both of TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/470,525

(22) Filed: Dec. 22, 1999

(51) Int. Cl.[7] ..... E21B 10/46

(52) U.S. Cl. ..... 175/73; 175/73; 175/431; 175/398; 76/108.4

(58) Field of Search ..... 175/61, 62, 73, 175/415, 417, 431, 378, 398; 76/108.2, 108.4

(56) References Cited

U.S. PATENT DOCUMENTS

| | | | |
|---|---|---|---|
| 5,421,420 | 6/1995 | Malone et al. | 175/61 |
| 5,423,389 | 6/1995 | Warren et al. | 175/75 |
| 5,456,141 * | 10/1995 | Ho | 76/108.2 |
| 5,549,171 * | 8/1996 | Mensa-Wilmot et al. | 175/431 |
| 5,607,024 * | 3/1997 | Keith et al. | 175/431 |
| 5,937,958 | 8/1999 | Mensa-Wilmot et al. | 175/398 |

FOREIGN PATENT DOCUMENTS

| | | | |
|---|---|---|---|
| 2 284 837 | 6/1995 | (GB) | E21B/7/08 |
| 2 323 868 | 10/1998 | (GB) | E21B/10/56 |

* cited by examiner

*Primary Examiner*—William Neuder
(74) *Attorney, Agent, or Firm*—Conley, Rose & Tayon, P.C.

(57) ABSTRACT

A drill bit with dropping tendencies includes an active region, a passive region, a biased mass distribution, an uneven torque generation, and an imbalance force vector directed toward the middle of the active region. Cutting elements in the active region of the drill bit may be more aggressive than those in the passive region through manipulation of, e.g., backrake angle, blade length, cutter sizes, blade angles and bit profile. The imbalance force vector may be achieved by manipulation of bit geometric parameters such as cutter radial position, angular position, longitudinal position, and rake angle.

36 Claims, 6 Drawing Sheets

DRAG BITS WITH PREDICTABLE INCLINATION TENDENCIES AND BEHAVIOR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates generally to drill bits and more generally to a bit designed to shift orientation of its axis in a predetermined direction as it drills. Even more particularly, the preferred embodiment relates to a drill bit having inclination reducing or dropping tendencies.

Drill bits in general are well known in the art. In recent years a majority of bits have been designed using hard polycrystalline diamond compacts (PDC) as cutting or shearing elements. The cutting elements or cutters are mounted on a rotary bit and oriented so that each PDC engages the rock face at a desired angle. The bit is attached to the lower end of the drill string and is typically rotated by rotating the drill string at the surface. The bit is typically cleaned and cooled during drilling by the flow of drilling fluid out of one or more nozzles on the bit face. The fluid is pumped down the drill string, flows across the bit face, removing cuttings and cooling the bit, and then flows back to the surface through the annulus between the drill string and the borehole wall.

The cost of drilling a borehole is proportional to the length of time it takes to drill the borehole to the desired depth and location. The drilling time, in turn, is greatly affected by the number of times the drill bit must be changed, in order to reach the targeted depth or formation. This is the case because each time the bit is changed the entire drill string, which may be miles long, be retrieved from the borehole section by section. Once the drill string has been retrieved and the new bit installed, the new bit must be lowered to the bottom of the borehole on the drill string, which again must be constructed section by section. This process, known as a "trip" of the drill string, requires considerable time, effort and expense. Accordingly, it is always desirable to minimize the number of trips that must be made in a given well.

In recent years, the PDC bit has become an industry standard for cutting formations of grossly varying hardnesses. The cutting elements used in such bits are formed of extremely hard materials and include a layer of polycrystalline diamond material. In the typical PDC bit, each cutter element or assembly comprises an elongate and generally cylindrical support member which is received and secured in a pocket formed in the surface of the bit body. A PDC cutter typically has a hard cutting layer of polycrystalline diamond exposed on one end of its support member, which is typically formed of tungsten carbide.

The configuration or layout of the PDC cutters on a bit face varies widely, depending on a number of factors. One of these is the formation itself, as different cutter layouts cut the various strata differently. In running a bit, the driller may also consider weight on bit, the weight and type of drilling fluid, and the available or achievable operating regime. Additionally, a desirable characteristic of the bit is that it be "stable" and resist vibration, the most severe type or mode of which is "whirl," which is a term used to describe the phenomenon wherein a drill bit rotates about an axis that is offset from the geometric center of the drill bit. Whirling subjects the cutting elements on the bit to increased loading, which causes the premature wearing or destruction of the cutting elements and a loss of penetration rate. Alternatively, U.S. Pat. Nos. 5,109,935 and 5,010,789 disclose techniques for reducing whirl by compensating for imbalance in a controlled manner, the contents of which are hereby incorporated by reference. In general, optimization of placement and orientation and overall design of the bit have been the objectives of extensive research efforts.

Directional and horizontal drilling have also been the subject of much research. Directional and horizontal drilling involves deviation of the borehole from vertical. Frequently, this drilling program results in boreholes whose remote ends are approximately horizontal. Advancements in measurement while drilling (MWD) technology have made it possible to track the position and orientation of the wellbore very closely. At the same time, more extensive and more accurate information about the location of the target formation is now available to drillers as a result of improved logging techniques and methods such as geosteering. These increases in available information have raised the expectations for drilling performance. For example, a driller today may target a relatively narrow, horizontal oil-bearing stratum, and may wish to maintain the borehole within the stratum once he has entered it. In more complex scenarios, highly specialized "design drilling" techniques are preferred, with highly tortuous well paths having multiple directional changes of two or more bends lying in different planes.

A common way to control the direction in which the bit is drilling is to steer using a turbine, downhole motor with a bent sub and/or housing. As shown in FIG. 1, a simplified version of a downhole steering system according to the prior art comprises a rig 1, drill string 2 having a motor 6 with or without a bent, and drill bit 8. The motor 6 with or without a bent 4 form part of the bottom hole assembly (BHA) and are attached to the lower end of the drill string 2 adjacent the bit 8. When not rotating, the bent housing causes the bit face to be canted with respect to the tool axis. The motor is capable of converting fluid pressure from fluid pumped down the drill string into rotational energy at the bit. This presents the option of rotating the bit without rotating the drill string. When a downhole motor is used with a bent housing and the drill string is not rotated, the rotating action of the motor normally causes the bit to drill a hole that is deviated in the direction of the bend in the housing. When the drill string is rotated, the borehole normally maintains direction, regardless of whether a downhole motor is used, as the bent housing rotates along with the drill string and thus no longer orients the bit in a particular direction. Hence, a bent housing and downhole motor are effective for deviating a borehole.

When a well is substantially deviated by several degrees from vertical and has a substantial inclination, such as by more than 30 degrees, the factors influencing drilling and steering change. This change in factors reduces operational efficiency for a number of reasons.

First, operational parameters such as weight on bit (WOB) and RPM have a large influence on the bit's rate of penetration, as well as its ability to achieve and maintain the required well bore trajectory. As the well's inclination increases and approaches horizontal, it becomes much more difficult to apply weight on bit effectively, as the well bottom is no longer aligned with the force of gravity. Furthermore, the increasing bend in the drill string means that downward force applied to the string at the surface is less likely to be translated into WOB, and is more likely to cause the buckling or deforming of the drill string. Thus, attempting to steer with a downhole motor and a bent sub normally reduces the achievable rate of penetration (ROP) of the operation and makes tool phase control very difficult.

Second, using the motor to change the azimuth or inclination of the well bore without rotating the drill string, a process commonly referred to as "sliding," means that the drilling fluid in most of the length of the annulus is not subject to the rotational shear that it would experience if the drill string were rotating. Drilling fluids tend to be thixotropic, so the loss of this shear adversely affects the ability of the fluid to carry cuttings out of the hole. Thus, in deviated holes that are being drilled with the downhole motor alone, cuttings tend to settle on the bottom or low side of the hole. This increases borehole drag, making weight on bit transmission to the bit very difficult and causing problems with tool phase control and prediction. This difficulty makes the sliding operation very inefficient and time consuming.

Third, drilling with the downhole motor alone during sliding deprives the driller of the advantage of a significant source of rotational energy, namely the surface equipment that would otherwise rotate the drill string and reduce borehole drag and torque. The drill string, which is connected to the surface rotation equipment, is not rotated during drilling with a downhole motor. Additionally, drilling with the motor alone means that a large fraction of the fluid energy is consumed in the form of a pressure drop across the motor in order to provide the rotational energy that would otherwise be provided by equipment at the surface. Thus, when surface equipment is used to rotate the drill string and the bit, significantly more power is available downhole and drilling is faster. This power can be used to rotate the bit or to provide more hydraulic energy at the bit face, for better cleaning and faster drilling.

For all of these reasons, it is desired to eliminate the sliding process from a directional or horizontal drilling process, by providing a device for altering the azimuth or inclination of a well without using a turbine, downhole motor or rotary steerable device. It is further desired to alter the direction of a well in a controlled manner, and to do so while rotating the drill string. It is further desired that this change in direction would be achieved with a drill bit having predetermined dropping tendencies, regardless of formation type, lithology, well trajectory, stratigraphy, or formation dip angles.

SUMMARY OF THE INVENTION

An embodiment of the invention is a drill bit having dropping tendencies for drilling a borehole, including a bit body and a bit face having an active zone and a passive zone, the bit face including a plurality of cutters, the bit body and plurality of cutters creating an imbalance force vector during the drilling of the borehole, the imbalance force vector being directed approximately midway through the active region. The cutters in the active zone are generally more aggressive than the cutters in the passive region, by, for example, manipulation of the backrake, blade layout or bit profile. In addition, the cutters in the active and passive zones will normally be arranged on the bit face by placement on blades, the length of the blades in the passive zone being less than the length of the blades in the active zone. This will correspond to an uneven mass distribution on the bit, which enhances the bias toward the bit's dropping tendencies. Also, the blade length differences as well as the differences in aggressiveness in the active and passive zones increases the net torque differential between the active and passive zones from the bit's cutting action when the active blades are on the low side of the well bore. The uneven mass distribution together with the gravitational force on the bit further intensifies the dropping tendency of the bit. Further, it is contemplated that the angle between redundant blades in the passive zone can be less than the angle between redundant blades in the active zone, to further enhance this specialized drilling action.

DETAILED DESCRIPTION OF A PREFERRED EMBODIMENT

Figure 1:
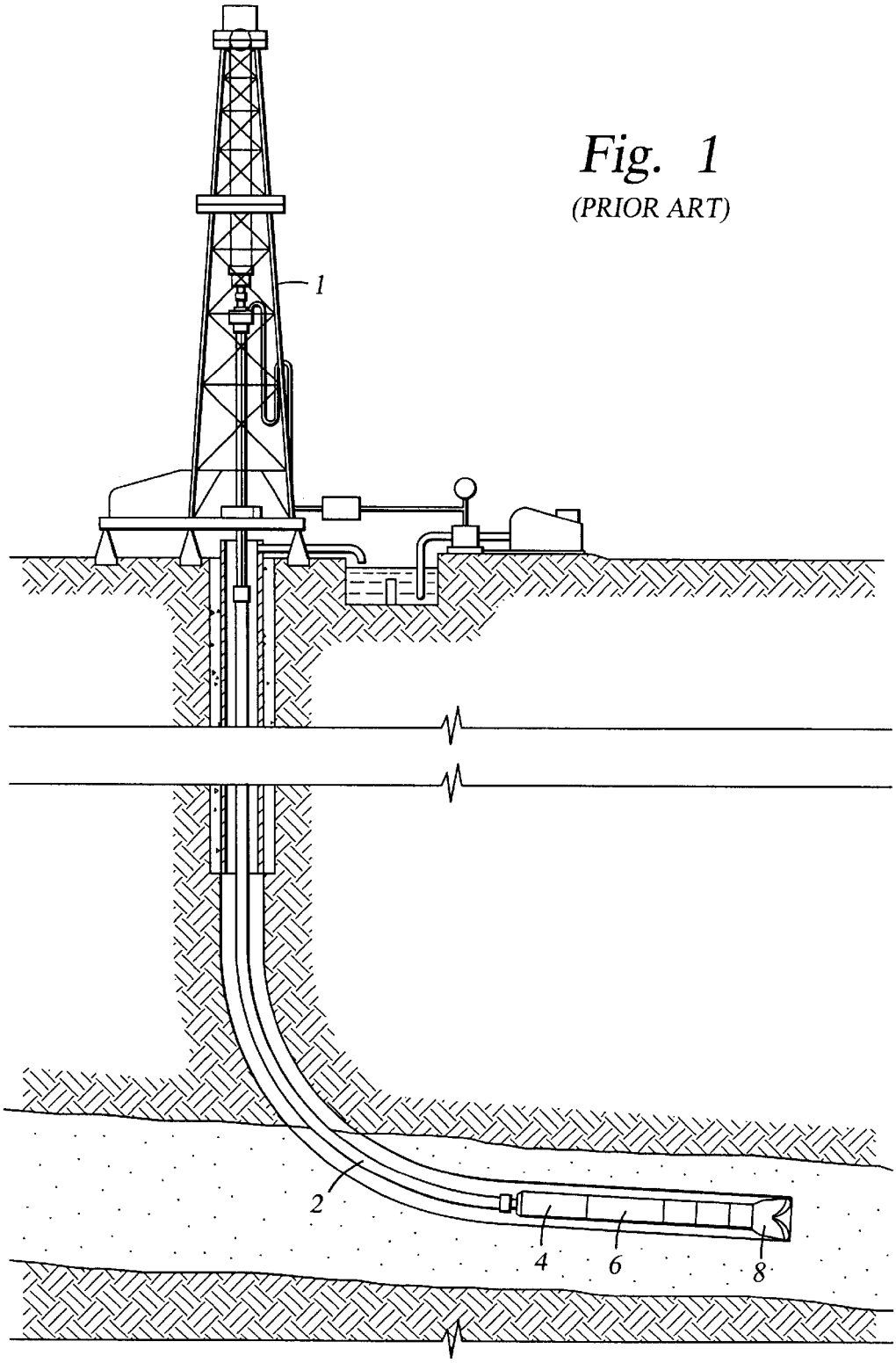
Fig. 1 (PRIOR ART)
FIG. 1 shows a drilling system.
Figure 2:
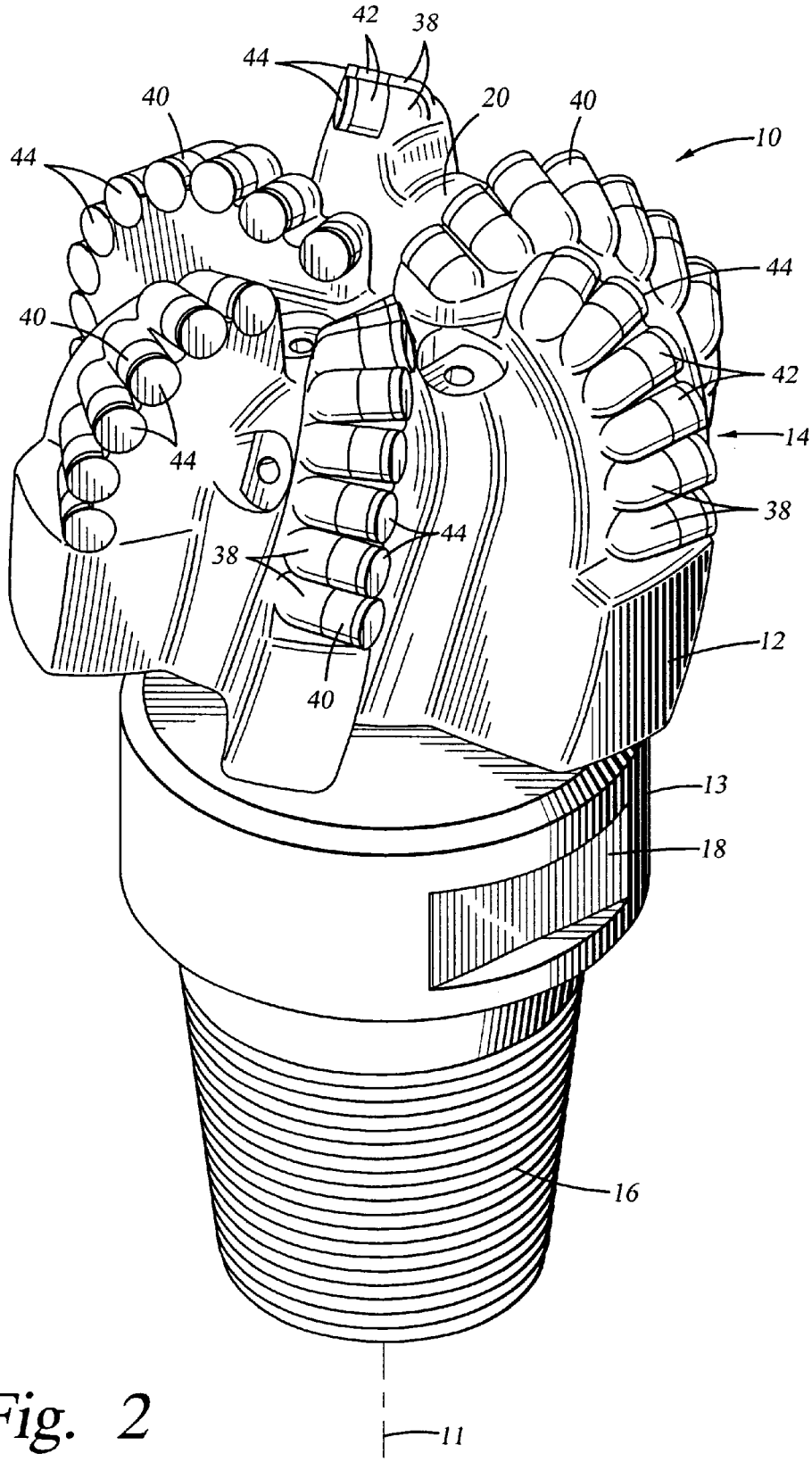
FIG. 2 is an isometric view of a drill bit.

A known drill bit is shown in FIG. 2. Bit 10 is a fixed cutter bit, sometimes referred to as a drag bit, and is preferably a PDC bit adapted for drilling through formations of rock to form a borehole. Bit 10 generally includes a bit body having shank 13, and threaded connection or pin 16 for connecting bit 10 to a drill string that is employed to rotate the bit for drilling the borehole. Bit 10 further includes a central axis 11 and a cutting structure on the face 14 of the drill bit, preferably including various PDC cutter elements 40 on a plurality of blades extending radially from the center of the cutting face. Also shown in FIG. 2 is a gage pad 12, the outer surface of which is at the diameter of the bit and establishes the bit's size. Thus, a 12" bit will have the gage pad at approximately 6" from the center of the bit.

Figure 3:
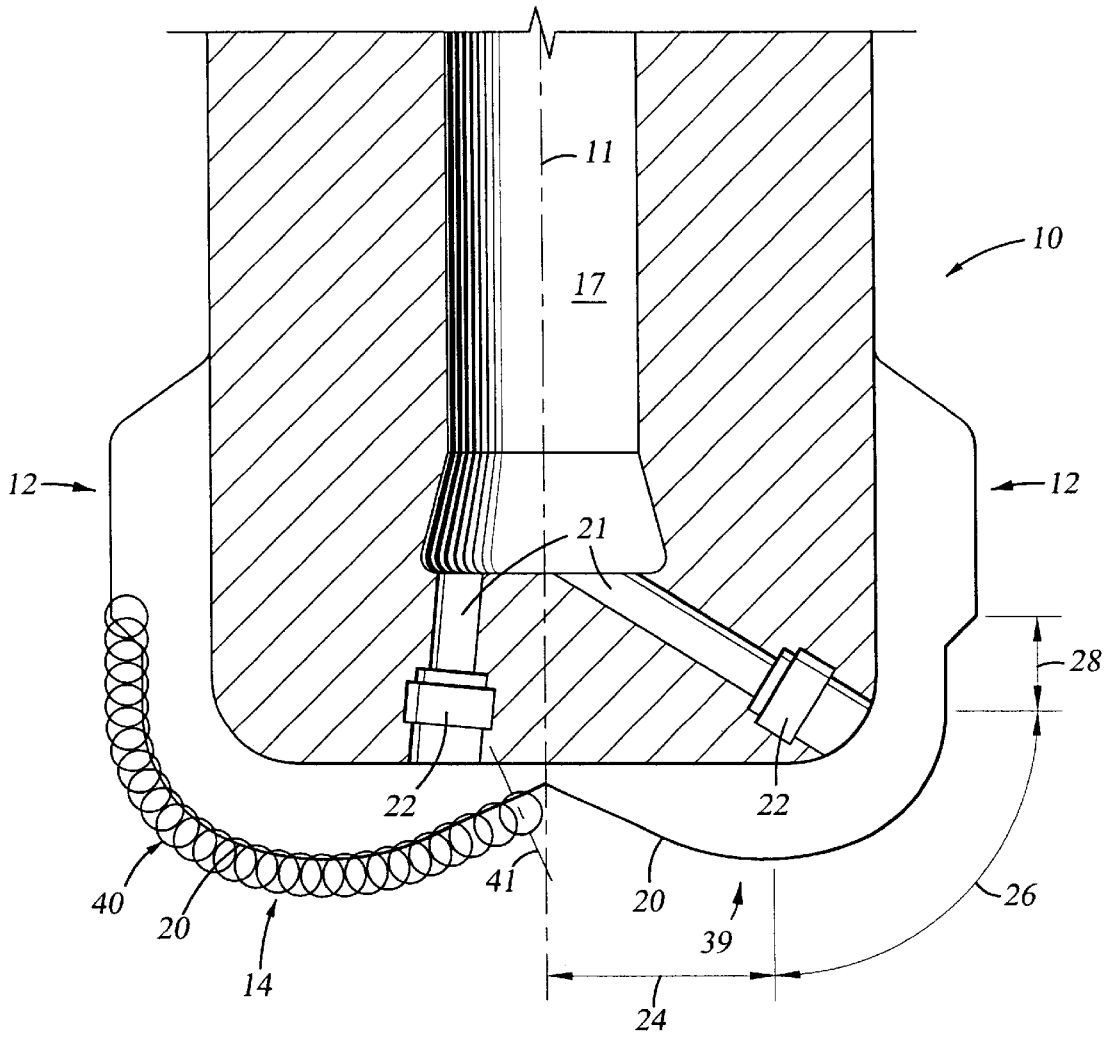
FIG. 3 is a cut-away view of a drill bit.

As best shown in FIG. 3, the drill bit body 10 includes a face region 14 and a gage pad region 12 for the drill bit. The face region 14 includes a plurality of cutting elements 40 from a plurality of blades, shown overlapping in rotated profile. The action of cutters 40 drills the borehole while the drill bit body 10 rotates. Downwardly extending flow passages 21 have nozzles or ports 22 disposed at their lowermost ends. Bit 10 includes six such flow passages 21 and nozzles 22. The flow passages 21 are in fluid communication with central bore 17. Together, passages 21 and nozzles 22 serve to distribute drilling fluid around the cutter elements 40 for flushing drilled formation from the bottom of the borehole and away from the cutting faces 44 of cutter elements 40 during drilling. Amongst several other functions, the drilling fluid also serves to cool the cutter elements 40 during drilling.

Cutting face 14 has a central depression proximate the central axis, a gage portion near the outer portion of the bit and a shoulder therebetween. This general configuration is well known in the art. Nevertheless, applicants have discovered that the tendency of the bit to deviate predictably from a straight-ahead path can be enhanced, and that a bit whose drilling deviates predictably and precisely to have dropping tendencies can be constructed by implementing several concepts. A similar drill bit is disclosed in U.S. Pat. No.

5,937,958, the contents of which are hereby incorporated by reference for all purposes.

Every cutter on the bit during drilling generates several forces such as normal force, vertical force (WOB), radial force, and circumferential force. All of these forces have a magnitude and direction, and thus each may be expressed as a force vector. During the balancing of the bit, all of these force vectors are summed and the force imbalance force vector magnitude and direction can then be determined. The process of balancing a drill bit is the broadly known process of ensuring that the force imbalance force vector is either eliminated, or is properly aligned.

A drill bit built in accordance with the principles of the invention preferably has an imbalance force force vector of about 10 to 25 percent and is preferably about 15 percent of its weight on bit, depending on its size. Methods for calculating and establishing the relationship between imbalance force and WOB are known to those skillful in the art.

The imbalance force force vector preferably lies in active zone 120 and more preferably is directed toward the middle region of active zone 120. Still more preferably, the imbalance force is oriented as closely as possible to the angular middle of active zone 120.

The tendency of the present bit to deviate predictably from straight-ahead drilling, and in particular its tendency to drill with a dropping tendency, increases as the magnitude of the imbalance force vector increases. Similarly, the tendency of the present bit to deviate with dropping tendencies increases as the imbalance force approaches the middle of the active zone 120. As explained generally below, the magnitude of the imbalance force vector can be increased by manipulating the geometric parameters that define the positions of the PDC cutters on the bit, such as back rake, side rake, height, angular position and profile angle. Likewise, the desired direction of the imbalance force can be achieved by manipulation of the same parameters. The mass imbalance on the drill bit can also be achieved by distributing the mass of the drill bit in a nonsymmetric manner, a methodology that is known to those skillful in the art.

Figure 4:
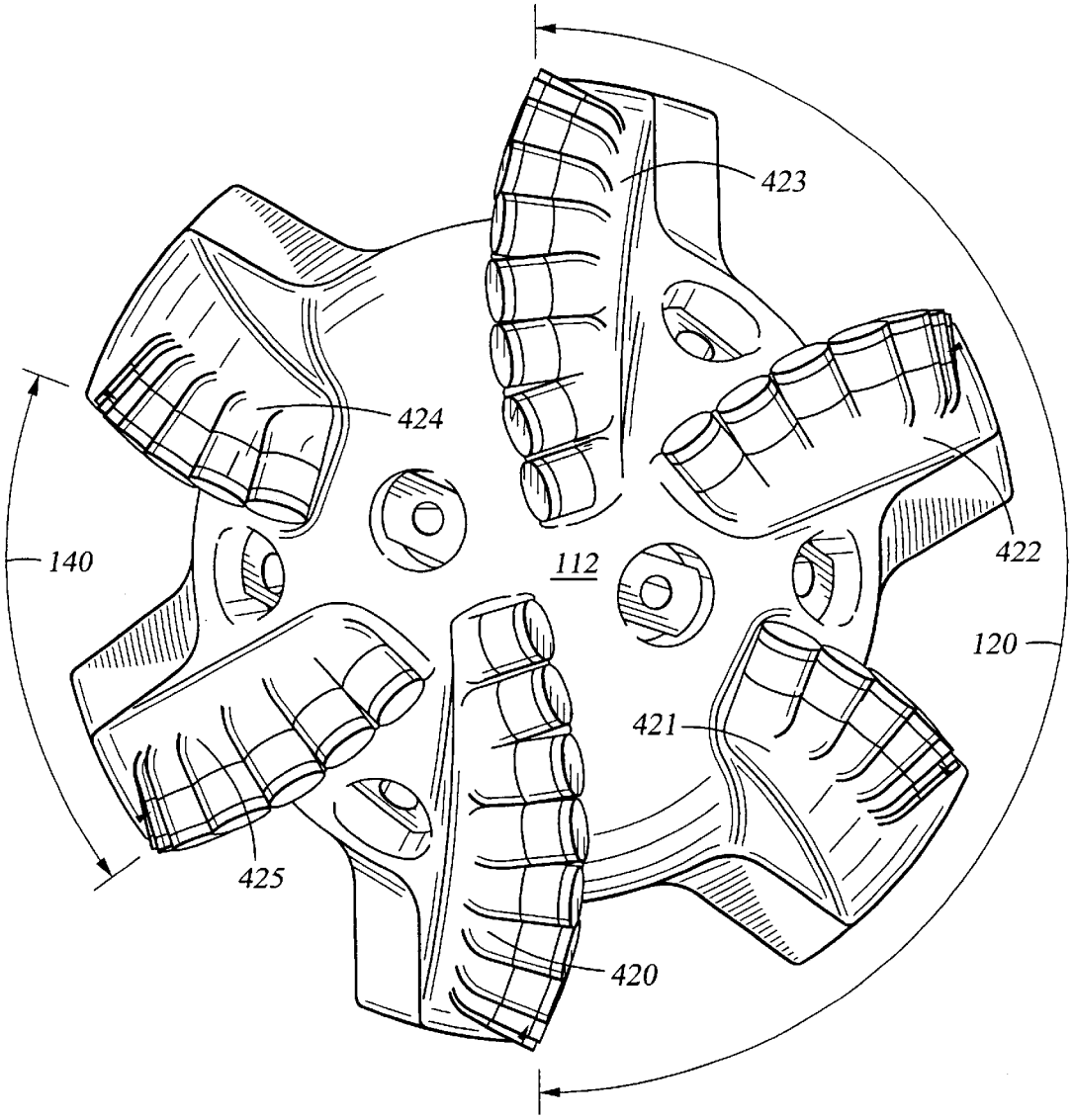
FIG. 4 is a top view of the face of a drill bit of the preferred embodiment.

Referring to FIG. 4, the cutting face 112 of a bit constructed in accordance with the preferred embodiment of the invention includes six blades 420–425. Each blade includes a plurality of cutting elements or cutters generally disposed radially from the center of cutting face 112 to generally form rows. These blades 420–425 form an active zone 120 and a passive zone 140. One preferable feature of the drill bit is that the cutters on the face of active zone 120 are more aggressive than those in passive zone 140. For this reason, the forces on cutters lying in the active zone are greater then the forces on cutters lying in the passive zone. Likewise, the torque generated by the cutters that lie in the active zone is greater than the torque generated by the cutters that lie in the passive zone.

Active zone 120 generally forms part of the circular face of the bit defined herein as the portion of the bit face extending from blade 420 to blade 423 and including the cutters of blades 420, 421, 422 and 423. According to a preferred embodiment, active zone 120 spans approximately 240 degrees and preferably approximately 180 degrees. Passive zone 140 generally forms part of the circular face of the bit defined herein as the portion of the bit face extending from blade 424 to blade 425 and includes the cutters of blades 424 and 425. According to a preferred embodiment, passive zone 140 spans approximately 160 degrees and preferably approximately 120 degrees. In any case, the angle of passive zone 140 is smaller than that of active zone 120.

In general the cutting elements in the active zone 120 are more aggressive to the formation than the cutting elements in the passive region 130. Thus, in a drill bit having cutting elements with some degree of backrake in both the passive and active zones, the backrake on cutters in the active zone is preferably less than the back rake on cutters in the passive zone. As is standard in the art, backrake may generally be defined as the angle formed between the cutting face of the cutter element and a line that is normal to the formation material being cut. Thus, with a cutter element having zero backrake, the cutting face is substantially perpendicular or normal to the formation material. Similarly, the greater the degree of back rake, the more inclined the cutter face is and therefore the less aggressive it is.

According to a preferred embodiment, the average back rack on cutters in the active zone for a 12¼" drill bit is 12 degrees, while the average back rake on cutters in the passive zone is 25 degrees. This is, however, dependent on bit size, the number of blades on the drill bit, and the number of cutters, which in turn is based on the hardness and the drillability of the rock. Increasing back rake on cutters in the passive zone relative to the back rake in the active zone in this manner establishes a more unequal distribution of torque on the bit face, and increases its tendency to drop from straight-ahead drilling. Similarly, the relative side rake, height, and profile angle between the cutters in the active zone and the passive zone may be manipulated as known in the art to make the cutters in the active zone more aggressive than those in the passive zone. The resulting force vectors may be determined and summed as known in the art. Iterative adjustment of these criteria results in a drill bit having an active region, a passive region, uneven and biased torque distribution, unequal workloads on cutters, mass imbalance, and a force imbalance force vector directed midway through the active region.

Another factor that influences the bit's tendency to drop is the relationship of the blades and the manner in which they are arranged on the bit face. Referring to FIG. 4, preferably the blades in the passive zone, blades 424 and 425, support non-dominant cutters. In addition, the cutters on blades 424 and 425 in the passive region are redundant. In contrast, preferably any blade in the active region contains dominant cutters. The cutters located on one of either blade 421 or blade 422 in the active zone are preferably redundant to those on blades 424, but are also non-dominant cutters. For purposes of the following explanation, it will be assumed that the blade 422 is the blade redundant, but it will be understood that the teachings herein can apply as easily to a drill bit in which the cutters on blade 421 are redundant to the cutters on blade 424. It should be appreciated that the cutters on blades 421 are not redundant to the cutters on blade 422, however. This arrangement results in the force and torque generated by the blades on the secondary profile that lie in the passive zone being reduced. The manner in which the dominant cutters are more aggressive can be achieved by a number of design criteria such as cutter size, rake angle, or angular distance between redundant blades as is known to those skilled in the art.

Blade 423 in FIG. 4 leads the active zone 120 and its cutters are non-redundant with respect to the cutters on any of the blades. Blade 420 is the most lagging blade of the active zone 120 and its cutters are non-redundant with respect to the cutters on any other blade. Thus, the cutters on blades 420 and 423 are non-redundant with respect to the other cutters on the drill bit of FIG. 4. By placing non-redundant cutters on blade 423, and non-redundant cutters on blade 420, the aggressiveness of these blades is made more pronounced and hence large cutting forces and drilling torque are generated in the active region of the drill bit. The arrangement described here is dependent on bit size and blade count. Other relationships establishing the same zonal behaviors between the active and passive zones are obvious to those skillful in the art upon understanding these teachings.

In addition, the angles between certain pairs of blades and the angles between blades having cutters in redundant positions affects the relative aggressiveness of the active and passive zones and hence the torque distribution on the bit. To facilitate the following discussion, the blade position is used herein to mean the position of a radius drawn through the last or outermost nongage cutter on a blade. According to the preferred embodiment shown in the Figures, the most important angles are those between blades 420 and 423 and between blades 424 and 425. These are preferably approximately 180 degrees and 60 degrees, respectively. The larger the angle between the leading and trailing blades 420 and 423 in the active zone, lying on the primary profile, the greater the angular spread of the torque generated by the active side of the bit. Thus, the stronger the dropping tendency. This also has the benefit of increasing the mass imbalance of the bit.

Another important set of angles are those between redundant blades 424 and 425 in the passive zone, and the angle between blades 422 and 421 in the active zone. As the angle between blades 424 and 425 in the passive zone on the secondary profile decreases to cause an increase of the angle between blades 424 and 422 (the redundant blades in the active zone and the lagging redundant blade in the passive zone), the loading and torque generated by the redundant blade 422 increases to intensify the aggressiveness of the active zone. As the aggressiveness of the active zone increases with respect to the passive zone, the relative torque generated in the active zone increases and the dropping tendency of the bit likewise becomes higher. According to a preferred embodiment, the blades in the passive zone having redundant cutters are no more than 100 degrees apart, but this depends on the bit size and number of blades on the drill bit.

Referring again to FIG. 4, each blade 420–425 ends at its outermost radius at a gage pad, with a radius r being measured for each gage pad from the longitudinal axis of the bit. According to the preferred embodiment, the radii $rad_{424}$ and $r_{425}$ of the gage pads on blades 424 and 425 in the passive zone are less than the radii $r_{420}$, $r_{421}$, $r_{422}$, and $r_{423}$ of the gage pads on blades 420, 421, 422 and 423. This, of course, means that a number of the cutters on blade 422 located near the radius of the gage pad are not redundant to the corresponding cutters on blades 424 and 425 because the blade lengths (and thus the location of the outermost cutters) are different. The difference between $r_{424}-r_{425}$ and $r_{420}-r_{423}$ will depend on bit size but is preferably approximately one inch for a 14¾" bit and about ¾" for 12¼" bit. This difference in the blade lengths and drill bit radii between the passive and active zones causes the drill bit to shift to the active zone side of a deviated borehole when blades 424 and 425 lie in positions that are close to the high side of the hole. This action reduces the friction with which blades 424 and 425 normally resist the aggressiveness of blades 420, 421, 422, and 423. This encourages the dropping tendency of the drill bit.

The undergage cutters of blades 424 and 425 also facilitates an increased dropping tendency for the bit in another way. Because the radii of the gage pads that correspond to blades 424 and 425 in the passive zone is less than the radii of the gage pads that correspond to blades 420–423 in the active zone, the portion of the drill bit including blades 424 and 425 normally has less mass than the portion of the drill bit defining the active zone. This effect may by accentuated by reducing the circumferential width of blades 424 and 425 as compared to the blades 420–423 in the active region, as shown in FIG. 4. For example, on a 12" drill bit, blades 420–423 may be 2½" wide, whereas blades 424, 425 may be 1½" wide. This uneven mass distribution on a drill bit built in accordance with the preferred embodiment causes the drill bit to shift to the active zone side of a deviated borehole when blades 424 and 425 are on the high side of the hole. The difference in the radial lengths of the blades and the generated torque differences therefore accentuates the action of the blades in the active zone to intensify the bits dropping tendency.

Figure 5:
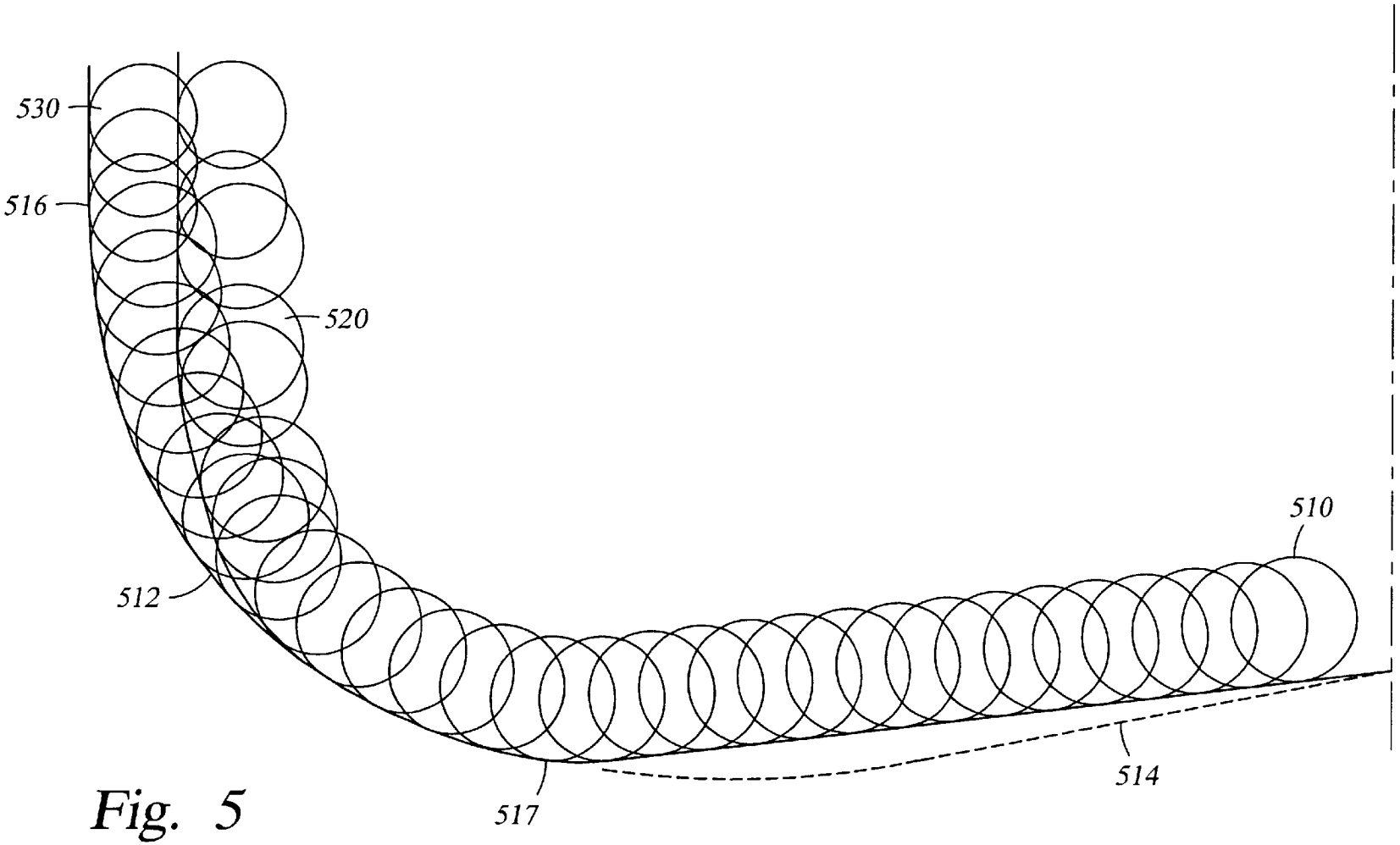
FIG. 5 is a rotated profile view of cutters mounted on a drill bit of the preferred embodiment.

Referring now to FIG. 5, the radial position of each cutter on a drill bit in rotated profile is shown. The cutting face has a central depression 514, a gage portion 516 and a shoulder 515 therebetween. The highest point (as drawn) on the cutter tip profiles defined the bit nose 517. Three exemplary cutter profiles are labeled 510, 520, and 530. It will be seen that certain cutters, although at differing axial positions as shown in FIG. 4, may occupy radial positions that are in similar radial position to other cutters on other blades. Cutting profile 510, for example, as applied to a drill bit as shown in FIG. 4, corresponds to a single trough cut by multiple cutting elements. Multiple cutters that correspond to essentially a single trough are known as being "redundant." The terms "dominant" or "redundantly dominant" are used to refer to a redundant cutter that cuts more aggressively than the other cutter(s) occupying the same radius. The term "dominant" or "independently dominant" are used to refer to cutters that are aggressive because they are not redundant to any other cutter on the drill bit.

Still referring to FIG. 5, other cutters on the preferred drill bit could be non-redundant. For example, certain cutters, such as corresponding to cutting profile 530, cut troughs that extend to the full diameter, or "gage," of the drill bit. Thus, the cutting tips of cutters in the active zone 120 of a drill bit built in accordance with the preferred embodiment are located to be exposed to the formation so as to cut aggressively. Thus, cutting elements at the far radial ends of blades 420, 421, 422, and 423 of FIG. 4 extend to bit diameter, as represented by cutting profile 530. On the other hand, the cutting tips of cutting elements located in the passive zone 140 are located to generally not be as exposed to the formation so as to cut less aggressively. Thus, the passive zone cutters corresponding to cutting profile 520 do not extend to the full diameter, or "gage," of the drill bit. In the preferred embodiment, such under gage cutters are present in the passive region 140. Thus, cutting elements at the far radial ends of blades 424 and 425 of FIG. 4 do not extend to full bit diameter.

Figure 6:
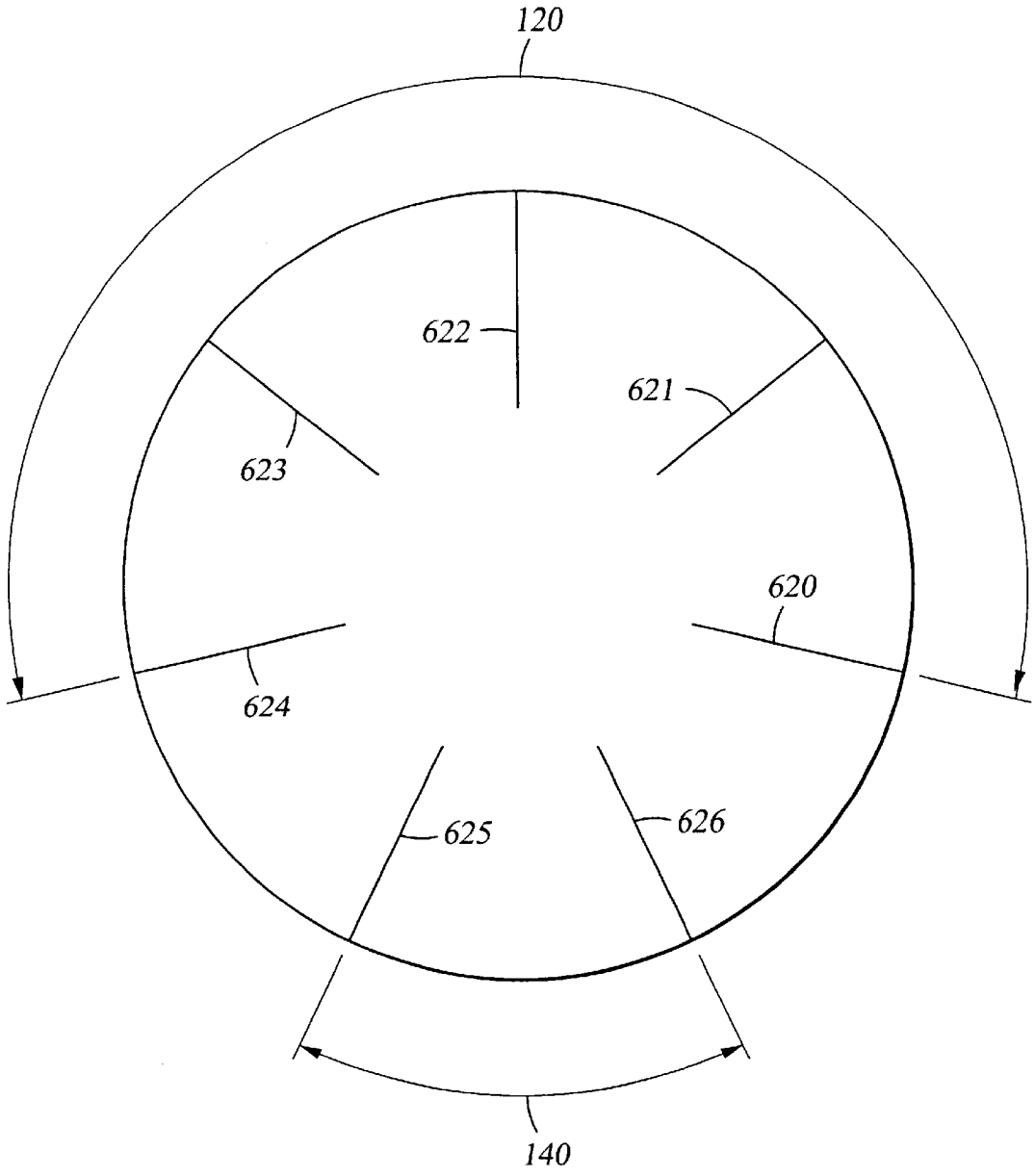
FIG. 6 is a geometric layout view of alternate embodiments of the invention.

FIG. 6 is a simplified geometric layout of the face of a drill bit, including a passive zone 140 and an active zone 120. Active zone 120 includes five blades 620–624. Passive zone 140 includes two blades 625–626.

The drill bit of FIG. 6 is constructed similarly to that shown in FIGS. 4 and 5, but may include a number of variations due to the additional blade 622, preferably located in the middle of active zone 120. As a first alternate embodiment, the cutters on blades 625 and 626 in the passive zone 140 are not redundant. Instead, blade 621 in the active zone 120 is redundant to blade 625, and blade 622 is redundant to blade 626. Blade 621 in the active zone is, however, dominant to blade 625 of the passive zone, and blade 622 of the active zone is dominant to blade 626 of the passive zone. In the first alternate embodiment, the cutters on blade 623 are independently dominant, as are blades 620 and 624.

In the second alternate embodiment of FIG. 6, blades 625 and 626 of the passive zone 140 are redundant. Any one of the blades 621, 622, or 623 are redundant (and dominant) to the cutters on blades 625 and 626. The remaining two blades of blades 621, 622, and 623 in the active zone are then made to be independently dominant.

In the third alternate embodiment of FIG. 6, blades 625 and 626 of the passive region are redundant. Blades 621 and 622 of the active region are made redundant to the cutters on blades 625 and 626. Generally speaking, if the cutters on blade 621 are provided with a smaller backrake than the cutters on blades 625 and 626, blade 621 will be a dominant blade. If, however, the cutters on blade 621 have the same or larger backrake than the cutters on blades 625 and 626 then the small angle between the cutters on blades 622 and 621 results in a blade 621 in the active zone that is non-dominant to the cutters on blades 625 and 626. Thus, making sufficient cutters on blade 621 non-dominant creates one of those drill bit configurations wherein the active zone 120 on the whole is dominant to the passive zone 140, but an individual blade in the active zone 120 is not.

In addition, a more aggressive side cutting structure is desirable for the active zone to increase dropping tendencies when the drill bit is highly inclined. Such aggressive side cutting may be obtained by employing the side cutting gage pad design disclosed in U.S. Ser. No. 09/368,833 and entitled "side cutting gage pad improving stabilization and borehole integrity" hereby incorporated by reference. These side-cutting gage pads may be used for blades present in the active region 120.

Variations to the preferred embodiment may be made and still be within the scope of the invention. For example, blades with non-dominant cutters can be added to the active region and still fall within the scope of the invention so longs as the active region on the whole remains dominant to the passive region, and so long as the force imbalance force vector remains directed about midway through the active region. In addition, a drill bit with dropping tendencies may be built having fewer than all the features disclosed herein. Further, the drill bit may have more, or fewer, blades than the drill bit described herein. Further, although the active zone preferably has a more aggressive cutting profile than the passive zone, not all of the cutters in the active zone need be more aggressive than all the cutters in the passive zone. It will also be apparent that the teachings herein can be applied to drill bits other than a PDC bit.

What is claimed is:

1. A drill bit with dropping tendencies for drilling a borehole, comprising:

a bit body having a longitudinal axis and a bit face having an active zone and a passive zone;

a first plurality of cutters on said face in said active zone;

a second plurality of cutters on said face in said passive zone, said first plurality of cutters being more aggressive than said second plurality of cutters, wherein an imbalance force vector exists on said drill bit during said drilling from said first plurality of cutters and said second plurality of cutters, said imbalance force vector being directed toward the approximate middle of said active region of said drill bit.

2. The drill bit of claim 1, further comprising:

a plurality of blades on said bit face, said plurality of cutters being generally arranged in rows on said blades, said active region being generally defined by a first set of consecutive blades on said drill bit and said passive region being generally defined by a second set of consecutive blades on said drill bit.

3. The drill bit of claim 2, wherein each of said blades in said active zone and said passive zone has a length measured from said longitudinal axis, said length for said blades in said passive zone being less than said length in said active zone.

4. The drill bit of claims 3, wherein said imbalance force vector is angularly directed at the middle of said active zone.

5. The drill bit of claim 2, wherein cutters on a first of said blades are redundant to the cutters on a second of said blades.

6. The drill bit of claim 5, wherein a pair of blades in said passive zone have redundant cutters and are spaced apart by a first angle and a pair of blades in said active region have redundant cutters and are spaced apart by a second angle, said first angle being less than said second angle.

7. The drill bit of claim 2, wherein said second set of blades contain cutters that are at similar radial positions.

8. The drill bit of claim 7, wherein said first set of blades contains at least one blade having cutters generally redundant, but dominant to said cutters on said second set of blades.

9. The drill bit of claim 2, further comprising:

a gage pad corresponding to each of said blades of in said active zone;

a gage pad corresponding to each of said blades of in said passive zone;

each of said gage pads corresponding to said blades in said active zone including cutting elements for side cutting.

10. The drill bit of claim 2, wherein said first plurality of cutters have cutting tips and said second plurality of cutters have cutting tips, and further wherein said cutting tips of said first plurality of cutters are more exposed than said cutting tips of said second plurality of cutters.

11. The drill bit of claim 1, wherein said imbalance force vector is angularly directed at the middle of said active zone.

12. The drill bit of claim 1, wherein said first plurality of cutters has a first backrake angle and said second plurality of cutters has a second backrake angle, said backrake angle of said first plurality being lower than said backrake angle of said second plurality.

13. The drill bit of claim 12, wherein said imbalance force vector is angularly directed at the middle of said active zone.

14. The drill bit of claim 1, wherein said drill bit has an uneven mass distribution locating increased mass in said active zone with respect to said passive zone.

15. The drill bit of claims 14, wherein said imbalance force vector is angularly directed at the middle of said active zone.

16. The drill bit of claim 1, wherein said active zone is less than about 240 degrees.

17. The drill bit of claim 16, wherein said active zone is approximately 180 degrees.

18. The drill bit of claim 17, wherein said imbalance force vector is angularly directed at the middle of said active zone.

19. The drill bit of claim 1, wherein said passive zone is approximately 120 degrees.

20. The drill bit of claim 1, wherein said imbalance force vector is from about 10 to about 40 percent of the weight on bit.

21. The drill bit of claim 20, wherein said imbalance force vector is about 20 percent of the weight on bit.

22. The drill bit of claim 20, wherein said drill bit includes only a single active region and said drill bit includes only a single passive region.

23. A drill bit having dropping tendencies, comprising:

a drill bit body having a drill bit diameter;

a first blade of a first length located on said drill bit supporting body and a first plurality of cutters;

a second blade of a second length and supporting a second plurality of cutters;

wherein said first length is greater than said second length, said first plurality of cutters is dominant to said second plurality of cutters, and wherein said drill bit has a force imbalance force vector while drilling, said force imbalance force vector being directed in a direction more proximate said first blade than said second blade.

24. The drill bit of claim 23, wherein said drill bit has exerted upon it a weight on bit force, and said force imbalance force vector has a magnitude of at least about 15 percent of said weight on bit force.

25. The drill bit of claim 23, wherein said first blade lies in a more aggressive cutting active region and said second blade lies in a less aggressive cutting passive region.

26. A method to design a drill bit with dropping tendencies, comprising:

a) defining an active zone on said drill bit that covers a first angular portion of said drill bit, includes a first set of cutters, and cuts formation with a first aggressiveness;

b) defining a passive zone on said drill bit that covers a second angular portion of said drill bit, includes a second set of cutters, and cuts formation with a second aggressiveness;

c) calculating an imbalance force vector that is the total vector from at least said first set of cutters and said second set of cutters, said imbalance force vector being directed generally toward the axial center of said active region.

27. The method of claim 26 wherein said first set of cutters has a first backrake angle and said second set of cutters has a second backrake angle, said backrake angle of said first set being lower than said backrake angle of said second set.

28. The method of claim 26, wherein said active zone and said passive zone each include a number of blades, and further wherein each of said blades in said active zone and said passive zone has a length measured from said longitudinal axis, said length for said blades in said passive zone being less than said length in said active zone.

29. The method of claim 26 wherein said drill bit has an uneven mass distribution locating increased mass in said active zone with respect to said passive zone.

30. The method of claim 26, wherein the angular extension of said active zone is less than about 240 degrees.

31. The method of claim 26 wherein the angular extension of said active zone is approximately 180 degrees.

32. The method of claim 26, wherein the angular extension of said passive zone is approximately 120 degrees.

33. The method of claim 26, wherein said drill bit includes a plurality of blades on a bit face, said first and second sets of cutters being generally arranged in rows on said blades, said active region being generally defined by a first set of consecutive blades on said drill bit and said passive region being generally defined by a second set of consecutive blades on said drill bit, said second set of blades containing cutters that are at approximately the same radial positions and wherein said first set of blades contains at least one blade having cutters generally redundant and dominant to said cutters on said second set of blades.

34. The method of claim 26, wherein said imbalance force vector is from about 10 to about 40 percent of the weight on bit.

35. The method of claim 26, wherein said imbalance force vector is about 20 percent of the weight on bit.

36. The method of claim 26 wherein said drill bit includes only a single active region and a single passive region.

* * * * *